US010134227B1

(12) United States Patent
Wakeford et al.

(10) Patent No.: US 10,134,227 B1
(45) Date of Patent: Nov. 20, 2018

(54) SYSTEMS AND METHODS FOR MAKING GAME CONTENT FROM A SINGLE ONLINE GAME ACCESSIBLE TO USERS VIA MULTIPLE PLATFORMS

(71) Applicant: ELECTRONIC ARTS INC., Redwood City, CA (US)

(72) Inventors: Kent Wakeford, Hillsborough, CA (US); Tomi Huttula, San Rafael, CA (US)

(73) Assignee: ELECTRONIC ARTS INC., Redwood City, CA (US)

( * ) Notice: Subject to any disclaimer, the term of this patent is extended or adjusted under 35 U.S.C. 154(b) by 94 days.

(21) Appl. No.: 15/048,947

(22) Filed: Feb. 19, 2016

(51) Int. Cl.
*A63F 9/24* (2006.01)
*G07F 17/32* (2006.01)

(52) U.S. Cl.
CPC ..... *G07F 17/3227* (2013.01); *G07F 17/3262* (2013.01); *G07F 17/3267* (2013.01); *G07F 17/3269* (2013.01); *G07F 17/3286* (2013.01)

(58) Field of Classification Search
None
See application file for complete search history.

(56) References Cited

U.S. PATENT DOCUMENTS 5,331,353 A * 7/1994 Levenson ..... H04N 5/44 348/E5.096
6,527,641 B1 3/2003 Sinclair
6,722,984 B1 * 4/2004 Sweeney, Jr. ..... A63F 13/06 341/176
6,896,618 B2 5/2005 Benoy et al.
6,913,536 B2 7/2005 Tomizawa
7,713,118 B2 5/2010 Roemer
8,147,328 B2 4/2012 Carroll et al.
8,246,466 B2 8/2012 Herrmann et al.
8,255,297 B2 8/2012 Morgenstern et al.
8,287,383 B1 10/2012 Etter et al.
8,292,743 B1 10/2012 Etter et al.
8,296,781 B1 10/2012 Lebaredian et al.
8,328,642 B2 12/2012 Mosites et al.
8,348,747 B2 1/2013 Arezina et al.
8,360,870 B2 1/2013 Herrmann et al.
(Continued)

FOREIGN PATENT DOCUMENTS

WO WO 2014/210286 12/2014

OTHER PUBLICATIONS

The Queen's Wrath, URL: http://destiny.wikia.com/wiki/The_Queen's_Wrath [retrieved Jan. 22, 2016] 2 pgs.
(Continued)

*Primary Examiner* — Paul A D'Agostino
(74) *Attorney, Agent, or Firm* — Knobbe, Martens, Olson and Bear, LLP

(57) ABSTRACT

A system and method that makes game content from a single online game accessible to users via multiple platforms. The multiple platforms may include virtual reality platforms and non-virtual reality platforms. Amounts of gameplay of the online game by the users via the virtual reality platforms may be monitored. The gameplay of the online game via the virtual reality platforms may be limited. As such, responsive to the amounts of gameplay by the users reaching gameplay thresholds, access to the online game through the first platform is restricted for the users until corresponding requirements are satisfied. The users may be able to play the online game via the non-virtual reality platforms while the gameplay of the online game via the virtual reality platforms is restricted.

20 Claims, 4 Drawing Sheets

(56) References Cited

U.S. PATENT DOCUMENTS 8,366,550 B2 2/2013 Herrmann et al.
8,388,452 B2 3/2013 Auterio et al.
8,527,332 B2 9/2013 Selby
8,595,336 B1 * 11/2013 Tsern ..... A63F 13/26 709/212
8,814,691 B2 8/2014 Haddick
8,888,585 B1 * 11/2014 Beechey ..... A63F 13/10 463/29
8,944,908 B1 2/2015 Wakeford et al.
9,104,886 B1 * 8/2015 Dolbakian ..... G06F 21/62
9,205,338 B1 12/2015 Wakeford
9,224,060 B1 * 12/2015 Ramaswamy ..... G06K 9/00912
2002/0090985 A1 7/2002 Tochner
2002/0158917 A1 10/2002 Sinclair
2003/0119576 A1 6/2003 McClintic
2003/0119581 A1 6/2003 Cannon et al.
2003/0211889 A1 11/2003 Walker
2005/0054439 A1 3/2005 Rowe et al.
2005/0076002 A1 4/2005 Williams et al.
2005/0113164 A1 5/2005 Bueche et al.
2005/0192097 A1 9/2005 Farnham
2005/0282638 A1 12/2005 Rowe
2006/0105838 A1 * 5/2006 Mullen ..... A63F 13/211 463/31
2006/0287080 A1 * 12/2006 Bychkov ..... A63F 13/00 463/29
2007/0004496 A1 1/2007 Gordon et al.
2007/0013515 A1 * 1/2007 Johnson ..... A63F 13/10 340/568.1
2007/0066403 A1 3/2007 Conkwright
2007/0173323 A1 7/2007 Johnson
2008/0182664 A1 7/2008 Kaplan et al.
2008/0200244 A1 8/2008 Rowe et al.
2008/0234034 A1 9/2008 Tessmer et al.
2008/0266250 A1 10/2008 Jacob
2008/0293466 A1 11/2008 Arakawa et al.
2008/0300049 A1 * 12/2008 Anderson ..... G07F 17/32 463/25
2008/0300055 A1 12/2008 Lutnick
2008/0318668 A1 12/2008 Ching et al.
2009/0051114 A1 2/2009 Robbers et al.
2009/0077463 A1 3/2009 Koster
2009/0181771 A1 7/2009 Sogabe
2009/0181774 A1 7/2009 Ratcliff
2009/0183226 A1 * 7/2009 Dean ..... G06F 21/62 726/1
2009/0251457 A1 * 10/2009 Walker ..... G06T 17/10 345/418
2009/0318232 A1 12/2009 Harris
2010/0046553 A1 * 2/2010 Daigle ..... G06F 21/35 370/474
2010/0056243 A1 3/2010 Czyzewski
2010/0093434 A1 * 4/2010 Rivas ..... A63F 13/12 463/35
2010/0144424 A1 6/2010 Rodgers et al.
2010/0166065 A1 7/2010 Perlman et al.
2010/0273557 A1 10/2010 Miyaki
2010/0279762 A1 11/2010 Sohn et al.
2010/0304839 A1 12/2010 Johnson
2011/0093361 A1 4/2011 Morales
2011/0106607 A1 5/2011 Alfonso et al.
2011/0118022 A1 * 5/2011 Aronzon ..... A63F 13/235 463/37
2011/0252079 A1 10/2011 Werner
2011/0264246 A1 * 10/2011 Pantoja ..... G06Q 30/02 700/92
2011/0312423 A1 12/2011 Mosites
2012/0009997 A1 1/2012 Youm
2012/0127284 A1 5/2012 Bar-Zeev
2012/0129598 A1 5/2012 Chao
2012/0150695 A1 6/2012 Fan et al.
2012/0172098 A1 7/2012 Baker
2012/0244948 A1 9/2012 Dhillon
2012/0244950 A1 9/2012 Braun
2012/0246301 A1 9/2012 Vyrros
2012/0258802 A1 10/2012 Weston
2012/0270623 A1 10/2012 Walker
2012/0316999 A1 12/2012 Koh
2012/0322545 A1 12/2012 Arnone
2012/0329551 A1 12/2012 Arezina
2013/0005437 A1 1/2013 Bethke et al.
2013/0014033 A1 1/2013 Hamick et al.
2013/0017870 A1 1/2013 Parker
2013/0045804 A1 2/2013 Ruke
2013/0061260 A1 * 3/2013 Maskatia ..... G07F 17/005 725/28
2013/0066695 A1 3/2013 Just
2013/0079082 A1 3/2013 Bancel et al.
2013/0079145 A1 3/2013 Lam et al.
2013/0085838 A1 4/2013 Tennenholtz et al.
2013/0137522 A1 5/2013 Kusano
2013/0159519 A1 6/2013 Hochberg
2013/0184064 A1 7/2013 Manning
2013/0196757 A1 8/2013 Latta
2013/0225305 A1 8/2013 Yang
2013/0254660 A1 * 9/2013 Fujioka ..... A63F 13/12 715/707
2013/0289744 A1 * 10/2013 Bavar ..... G05B 11/01 700/9
2014/0024445 A1 1/2014 Aller
2014/0024464 A1 1/2014 Belakovsky
2014/0028850 A1 1/2014 Keating
2014/0031129 A1 1/2014 Morrison
2014/0066176 A1 3/2014 Letourneau
2014/0094315 A1 4/2014 Stine
2014/0113716 A1 4/2014 Mukhopadhyay
2014/0121015 A1 5/2014 Massing
2014/0122720 A1 5/2014 Jung et al.
2014/0128161 A1 5/2014 Latta
2014/0129630 A1 * 5/2014 Nikain ..... A63F 13/10 709/204
2014/0192084 A1 7/2014 Latta
2014/0221084 A1 8/2014 Morrison, III
2014/0258394 A1 9/2014 Lucero
2014/0274308 A1 9/2014 Guinn et al.
2014/0278686 A1 9/2014 Mullings
2014/0280504 A1 * 9/2014 Cronin ..... H04L 67/38 709/203
2014/0302915 A1 10/2014 Lyons
2014/0309002 A1 10/2014 Ogorman
2014/0329589 A1 * 11/2014 Hawver ..... A63F 13/42 463/29
2014/0342818 A1 * 11/2014 Smith ..... A63F 13/06 463/29
2014/0357344 A1 12/2014 Grier
2014/0357370 A1 * 12/2014 Soelberg, III ..... A63F 13/428 463/37
2014/0358651 A1 12/2014 Koh et al.
2014/0370992 A1 12/2014 Cudak
2014/0378214 A1 12/2014 Suzuki
2015/0005052 A1 1/2015 Harrington
2015/0011277 A1 1/2015 Wakeford
2015/0080083 A1 3/2015 Tamaoki
2015/0080127 A1 3/2015 Tamaoki
2015/0170455 A1 6/2015 Rad
2015/0242340 A1 * 8/2015 Ishikawa ..... G06F 13/102 719/321
2015/0253574 A1 * 9/2015 Thurber ..... G02B 27/0172 359/630
2015/0362733 A1 * 12/2015 Spivack ..... A63F 13/26 345/633
2016/0300388 A1 * 10/2016 Stafford ..... A63F 13/69

OTHER PUBLICATIONS

Totilo, Assassin's Creed Unity Finally Drops App, Web Requirements for Unlocks [Update], Dated Feb. 18, 2015, 5pgs.

A Cautious Celebration of Pay-or-Wait to Play Games, URL: http://www.michaelbraun.me/2014/07/a-cautious-celebration-of-pay-or-wait-to-play-games [retrieved Jan. 21, 2016] 3pgs.

(56) References Cited

OTHER PUBLICATIONS

World of Warcraft Armory, URL: https://play.google.com/store/apps/details?id=com.blizzard.wow&hl=en [retrieved Jan. 20, 2016] 4pgs.
Companion App (iFruit)—GTA 5 Wiki Guide—IGN, URL http:www.ign.com/wikis/ gta-5/Companion_App_(iFruit)) [retrieved Jan. 20, 2016] 17pgs.
The Free GTAV iFruit and Game Manual Companion Apps, URL: http://www.rockstargames.com/newswire/article/51371/the-free-gtav-ifruit-and-game-manual-companion-apps.html [retrieved on Jan. 20, 2016] 5 pgs.
FIFA 16—Companion App—EA Sports, URL: https://www.easports.com/fifa/features/companion-app [retrieved Jan. 22, 2016] 5pgs.
"Difference in Gameplay Mechanics Between Gold, Silver and Bronze" [online], Apr. 2, 2012 [retrieved Jan. 6, 2015]. Retrieved from the Internet <URL:http://forum.bioware.com/topic/309690-difference-in-gameplay-mechanicsbetween-gold-silver-and-bronze/>, 7 pages.
PCT International Preliminary Report on Patentability for PCT/US2014/044297, dated Jan. 7, 2016, 6 pages.

* cited by examiner

SYSTEMS AND METHODS FOR MAKING GAME CONTENT FROM A SINGLE ONLINE GAME ACCESSIBLE TO USERS VIA MULTIPLE PLATFORMS

FIELD OF THE DISCLOSURE

This disclosure relates to a system and method for making game content from a single online game accessible to users via multiple platforms.

BACKGROUND

Typically, online mobile games are played via non-virtual reality platforms. Incorporating virtual-reality platforms into online games accessible via mobile platforms presents a challenge because users may be hesitant to try virtual reality and/or users may get caught up in virtual reality game play and avoid playing the online game via the mobile platforms. Due to the immersive and restrictive nature of virtual reality, it may not be played as frequently or while a user is on-the-go. As such, game providers do not want to lose mobile application play because it may reduce the overall amount users play the game and/or spend money in the game. On the other hand, virtual reality increases in the level of interaction a user may experience with the online game. Achieving a balance between enticing users to experience virtual reality without losing mobile platform gameplay presents a unique challenge for online game providers.

SUMMARY

One aspect of the disclosure relates to making game content from a single online game available to users via multiple platforms. The system may be configured to provide an online game that may be played via multiple platforms. The multiple platforms may include virtual reality platforms and non-virtual reality platforms. The system may be configured to monitor the gameplay of the users via the virtual reality platforms. If the amount of gameplay by a user via the virtual reality platform reaches a threshold amount of gameplay, the system may limit access to the online game via the virtual reality platform. The user's access to the online game via the virtual reality platform may be restricted until the user satisfies a requirement. While the virtual reality platform is restricted and/or while the requirement is unsatisfied, the online game may be available to the user via the non-virtual reality platform. As such, the user may still be able to play the online game via the non-virtual reality platform. Thus, the system and/or method described herein may limit users gameplay via the virtual reality platforms while encouraging users to remain engaged with the online game via the non-virtual reality platforms.

A system for making game content from a single online game accessible to users via multiple platforms may include one or more servers. The servers may operate in a client/server architecture with one or more client computing platforms. The client computing platforms may be associated with the users of the online game. The client computing platforms may include virtual reality platforms and non-virtual reality platforms. The servers may be configured to execute one or more of: a game component, a gameplay component, a user component, a platform component, a requirement component, a notification component, and/or other components. The client computing platforms may be configured to execute one or more components the same as or similar to the servers.

Game component 112 may be configured to execute a game instance of an online game played via multiple platforms. The multiple platforms may include virtual reality platforms and non-virtual reality platforms. For example, the virtual reality platforms may include a first platform associated with a first user. The non-virtual reality platforms may include a second platform associated with the first user. Game component 112 may be configured to use the game instance to generate game state information that is transmitted to client computing platforms over a network. The game state information may facilitate presentation of views of the online game to the users via the client computing platforms. Game component 112 may transmit the game state information over the network to the client computing platforms. Transmitting the game state information may cause the client computing platforms to present views of the online game. Views of the online game presented via a virtual reality platform may include views presented on a head-mounted display device and/or other immersive views (e.g., causing the user to have the perception of being physically present in a virtual world). Views of the online game presented via a non-virtual reality platform may include views presented on a touch screen, television, computer monitor, and/or other non-immersive views (e.g., not fully immersive such that the user does not have the perception of being physically present in a virtual world).

Gameplay component 114 may be configured to monitor gameplay by the users via the virtual reality platforms. Monitoring the gameplay of users may include monitoring an amount of gameplay via the virtual reality platform and/or the non-virtual reality platform associated with the user. For example, monitoring the gameplay by the first user may include monitoring an amount of gameplay by the first user via the first platform (e.g., the virtual reality platform).

The amount of gameplay may indicate an amount of time playing the game via a given platform. The amount of time may include one or more of a cumulative amount of time, an amount of time for a given period of time (e.g., hour(s), day(s), week(s), month(s), etc.), an amount of time per play session, an amount of time per level within the online game, an average amount of time, a frequency, and/or any other amount of time. In some implementations, the amount of gameplay may relate to a user's activity within the online game. The amount of gameplay may include one or more of a quantity of experience segments completed, a level achieved, a boss defeated, an amount of virtual items and/or resources used and/or obtained, an amount of stamina depleted and/or obtained, one or more actions performed, and/or other amounts of gameplay. Experience segments may include portions of the online game that may be completed and/or played by the users. For example, experience segments may include one or more of a game tile, game level, event, challenge, quest, nodes, mini-game, and/or other experience segment within the online game.

The platform component may be configured to limit gameplay of the online via the virtual reality platforms. Gameplay via the virtual reality platforms may be limited responsive to the amount of gameplay reaching a gameplay threshold. The gameplay threshold may be a limit on the amount of gameplay a user may participate in via a given platform (e.g., the virtual reality platform or the non-virtual reality platform) for a given period of time and/or segment of the online game. Limiting gameplay via the virtual reality platform may include restricting access to the online game via the virtual reality platform. Access via the virtual reality platform associated with the user may be restricted until a requirement is satisfied. For example, responsive to the amount of gameplay by the first user via the first platform (e.g., the virtual reality platform) reaching a gameplay threshold, access to the online game through the first platform may be restricted for the first user.

The platform component may enable the user to play the online game via another platform when access to the online game via a given platform is limited and/or while the requirement is unsatisfied. For example, the users may be able to play the online game via the non-virtual reality platforms while the gameplay of the online game via the virtual reality platforms is restricted. As such, the first user may be able to play the online game via the second platform (e.g., the non-virtual reality platform) while the first requirement is unsatisfied.

In some implementations, the requirement component may be configured to determine the requirement based on the amount of gameplay by the user via the virtual reality platform and/or the non-virtual reality platform. As such, the requirement component may be configured to determine the first requirement based on one or both of the amount of gameplay by the first user via the first platform (e.g., the virtual reality platform), and the second amount of gameplay by the first user via the second platform (e.g., the non-virtual reality platform). The requirement component may be configured to determine whether the requirement (e.g., the first requirement) has been satisfied by the user (e.g., the first user). The notification component may be configured to effectuate presentation of a notification to a user via a given platform. The notification presented may indicate that the gameplay threshold has been reached and/or the requirement.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
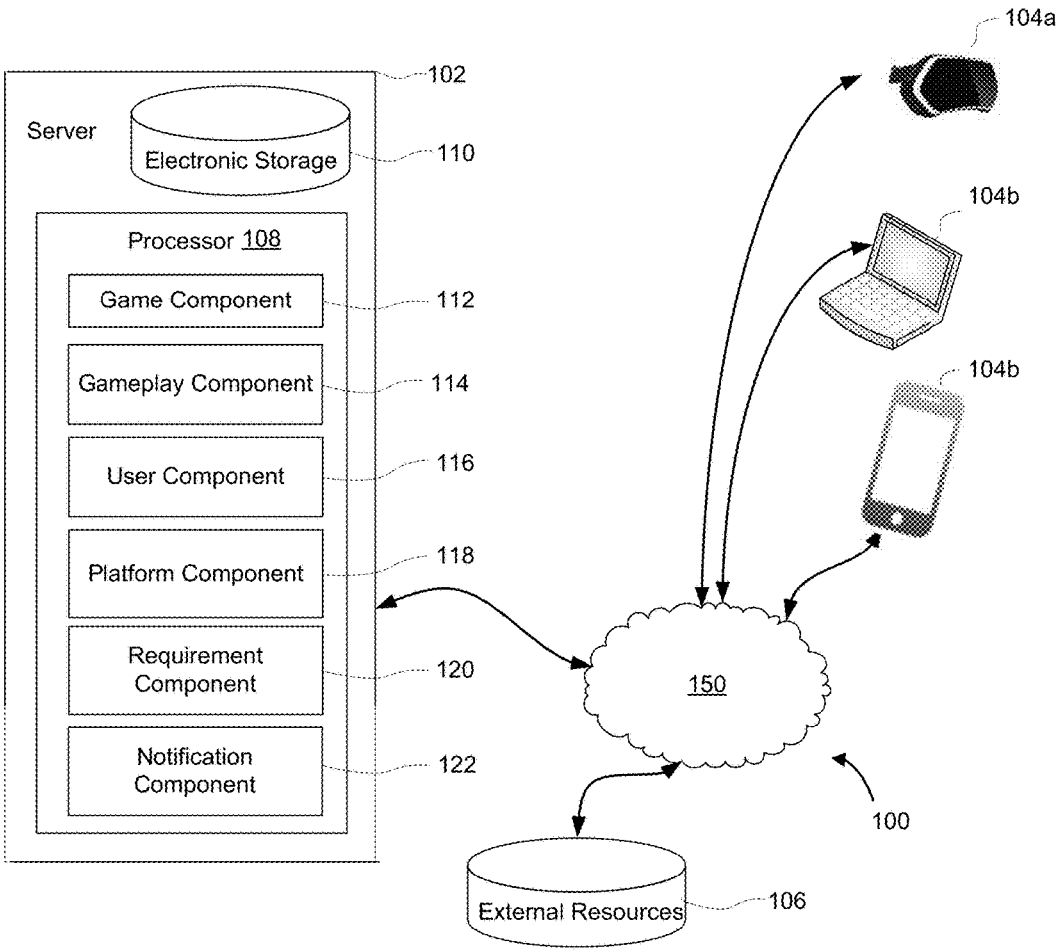
FIG. 1 illustrates a system for making game content from a single online game accessible to users via multiple platforms, in accordance with one or more implementations.

FIG. 1 illustrates a system 100 that makes game content from a single online game accessible to users via multiple platforms. The multiple platforms may include client computing platforms via which users play the online game. The client computing platforms may include virtual reality platforms and non-virtual reality platforms. The virtual reality platforms may present views of the online game in a manner that simulates immersion (e.g., the user's perception of being physically present within a non-physical world) within the online game. The online game may have a higher interactive potential when played via the virtual reality platforms than when played via the non-virtual reality platforms. For example, the virtual reality platforms may be able to support additional and/or increased motion inputs, views, visibility, and/or other interactions a user may have with the online game. However, the virtual reality platforms may also be more restrictive because a user may not always have access to a virtual reality platform or may not be able to immerse themselves in the online game as required by virtual reality. Thus, a balance between playing the online game via the virtual reality platforms and the non-virtual reality platforms may improve the users' experience with the game and introduce new monetization opportunities, without losing the flexible and constant access to the online game provided by non-virtual reality platforms.

The online game may be provided and/or executed by system 100. Providing the online game may include hosting the online game over a network. In some implementations, system 100 may include one or more servers 102 configured for hosting online games. Server 102 may be configured to communicate with one or more client computing platforms 104 according to a client/server architecture, and with each other. The users may access system 100, the online game, and/or the game space associated with the online game via client computing platforms 104, such as client computing platforms 104*a-b* as shown. Client computing platforms 104 may include virtual reality platform(s) 104*a* and non-virtual reality platform(s) 104*b*. Server 102 may comprise a processor 108 configured to execute machine readable instructions to implement system components. The computer program components may include one or more of a game component 112, a gameplay component 114, a user component 116, a platform component 118, a requirement component 120, a notification component 122, and/or other components.

The game component 112 may be configured to execute a game instance of an online game played via multiple platforms. The online game may be played by users via virtual reality platforms and non-virtual reality platforms. The virtual reality platforms may provide an immersive gaming experience by simulating the user's presence within the virtual space in which the online game is played. The game component 112 may be configured to use the game instance to generate game state information that is transmitted to client computing platforms 104 over a network 150. The game state information may facilitate presentation of views of the online game to the users via the client computing platforms. The game component 112 may transmit the game state information over network 150 to the client computing platforms 104, causing client computing platforms 104 to present views of the online game. Views of the online game presented via virtual reality platform 104*a* may include views presented on a head-mounted display device. The views may be presented stereoscopically—one for each eye—via the head mounted display device and the user's brain combines them creating a three-dimensional experience. The head mounted display device may include a head and/or eye tracking system that tracks movement of the user as they move their head, eyes, and/or themselves around the virtual space in which the online game is played. Views of the online game presented via a non-virtual reality platform may include views presented on a display for one or more of a mobile device (e.g., a smart phone, tablet, laptop), desktop computer, gaming console, televisions, and/or other non-virtual reality platforms.

In some implementations, the game content for the online game provided to the users via the virtual reality platforms may be different than the game content provided to the users via the non-virtual reality platforms. For example, different, but related game content, may be provided to the users via the non-virtual reality platforms compared to the virtual reality platforms. To illustrate, where first game content is provided to the first user via the first platform (e.g., a virtual reality platform) and second game content is provided to the first user via the second platform (e.g., a non-virtual reality platform), the second game content may be different than the first game content. The second game content may be related to the first game content. Differences in the game content provided via a given platform may include one or more of: dimension differences (e.g., three-dimensional vs two-dimensional), location differences within the virtual space, character differences, and/or other differences. Relatedness of the game content may indicate that one or more of the subject matter, characters, virtual environment, in the online game via played via a virtual reality platform and played via the non-virtual reality platform are related. By way of non-limiting example, in the online game played via the virtual reality platform, the user may be an astronaut in space and/or on a planet. In the online game played via the non-virtual reality platform, the user may be an astronaut that has returned to the space station or base.

Execution of the game instance may enable interaction by the users with the online game and/or each other. Game component 112 may be configured to perform operations in the game instance in response to commands received over network 150 from client computing platforms 104. Users may participate in the online game through client game applications implemented on the client computing platforms 104 associated with the users.

Within the instance of the online game, users may interact with elements in the online game and/or with each other through gameplays provided by the online game. The gameplays may include role-playing, first-person shooter, real-time strategy, turn-based strategy, simulation, music or rhythm playing, social interaction, twitching and/or any other gameplays. The execution of the instance of the online game by game component 112 may include determining a game state associated with the online game. The game state information may include information defining a virtual space in which the online game is played. The state may be communicated (e.g., via streaming visual data, via object/position data, and/or other state information) from server(s) 102 to client computing platforms 104 for presentation to users. The state determined and transmitted to a given client computing platform 104 may correspond to a view for a user character being controlled by a user via the given client computing platform 104. The state determined and transmitted to a given client computing platform 104 may correspond to a location in a virtual space associated with the online game. The view described by the state for the given client computing platform may correspond, for example, to the location from which the view is taken, the location the view depicts, and/or other locations, a zoom ratio, a dimensionality of objects, a point-of-view, and/or view parameters of the view. One or more of the view parameters may be selectable by the user.

The instance of the online game may be persistent. That is, the online game may continue on whether or not individual users are currently logged in and/or participating in the online game. A user that logs out of the online game and then logs back in some time later may find the virtual space and/or the online game has been changed through the interactions of other users with the online game during the time the user was logged out. These changes may include changes to the simulated physical space, changes in the user's inventory, changes in other users' inventories, changes experienced by non-user characters, and/or other changes.

The instance of the online game may comprise a simulated virtual space, e.g., a virtual space that is accessible by users via clients (e.g., client computing platforms 104) that present the views of the virtual space to a user. The virtual space may have a topography, express ongoing real-time interaction by one or more users and/or include one or more objects positioned within the topography that are capable of locomotion within the topography. In some instances, the topography may be a two-dimensional topography. In other instances, the topography may be a three-dimensional topography. The topography may include dimensions of the space and/or surface features of a surface or objects that are "native" to the space. In some instances, the topography may describe a surface (e.g., a ground surface) that runs through at least a substantial portion of the space. In some instances, the topography may describe a volume with one or more bodies positioned therein (e.g., a simulation of gravity-deprived space with one or more celestial bodies positioned therein). The instance executed by the computer components may be synchronous, asynchronous, and/or semi-synchronous.

The instance of the online game may comprise virtual entities automatically controlled in the instance of the online game. Such virtual entities may not be associated with any user. As such, the automatically controlled virtual entities may be generated and/or developed by artificial intelligence configured with the server(s) 102 by a provider, administrator, moderator, and/or any other entities related to the online game. These automatically controlled entities may evolve within the online game free from user controls and may interact with the entities controlled by or associated with the users, other automatically controlled virtual space entities, as well as the topography of the virtual space. Certain manifested traits may be associated with the automatically controlled entities in accordance with the artificial intelligence configured with the server 102. As used herein, such automatically controlled virtual space entities in the instance of the online game are referred to as "non-player entities".

It should be understood the above description of the manner in which state of the virtual space associated with the online game as determined by game component 112 is not intended to be limiting. The game component 112 may be configured to express the virtual space in a more limited, or richer, manner. For example, views determined for the online game representing the game state of the instance of the online game may be selected from a limited set of graphics depicting an occurrence in a given place within the online game. The views may include additional content (e.g., text, audio, pre-stored video content, and/or other content) that describes particulars of the current state of the place, beyond the relatively generic graphics. For example, a view may include a generic battle graphic with a textual description of the opponents to be confronted. Other expressions of individual places within the online game are contemplated.

Within the instance of the online game executed by game component 112, the users may participate by controlling one or more of an element in the virtual space associated with the online game. The user-controlled elements may include avatars, user characters, virtual space units (e.g., troops), objects (e.g., weapons, horses, vehicle and so on), simulated physical phenomena (e.g., wind, rain, earthquakes, and/or other phenomena), and/or other user-controlled elements. The user-controlled avatars may represent the users in the virtual space. The user characters may include heroes, knights, commanders, leaders, generals and/or any other virtual space entities that may possess strength, skills, abilities, magic powers, knowledge, and/or any other individualized attributes. The virtual space units controlled by the user may include troops and/or any other game entities that may be trained, recruited, captured, and/or otherwise acquired by the users in groups or en-mass. The objects controlled by the users may include weapons, vehicles, projectiles, magic items, wardrobes, boots, armor, knapsacks, medicine, healing potion, and/or any other virtual items that may be employed by the users for interaction within the online game.

In any case, the user-controlled elements may move through and interact with the virtual space (e.g., non-player entities, elements controlled by other users and/or topography in the virtual space) associated with the online game. The elements controlled by a given user may be created and/or customized by the given user. The given user may have an "inventory" of virtual goods and/or currency usable within the virtual space.

Controls of virtual elements in the online game may be exercised through commands input by a given user through client computing platforms 104. The given user may interact with other users through communications exchanged within the virtual space. Such communications may include one or more of textual chat, instant messages, private messages, voice communications, and/or other communications. Communications may be received and entered by the users via their respective client computing platforms 104. Communications may be routed to and from the appropriate users through server(s) 102 (e.g., through the game component 112).

A given user may input commands with specific parameters to undertake specific deeds, actions, functions, spheres of actions and/or any other types of interactions within the virtual space. For example, the given user may input commands to construct, upgrade and/or demolish virtual buildings; harvest and/or gather virtual resources; heal virtual user-controlled elements, non-player entities and/or elements controlled by other users; train, march, transport, reinforce, reassign, recruit, and/or arrange troops; attack, manage, create, demolish and/or defend cities, realms, kingdoms, and/or any other virtual space locations controlled by or associated with the users; craft or transport virtual items; interact with, compete against or along with non-player entities and/or virtual space elements controlled by other users in combats; research technologies and/or skills; mine and/or prospect for virtual resources; complete missions, quests, and/or campaigns; exercise magic power and/or cast spells; and/or perform any other specific deeds, actions, functions, or sphere of actions within the virtual space. In some examples, the given user may input commands to compete against elements in an environment within the virtual space—i.e., Player vs. Environment (PvE) activities. In some examples, the given user may input commands to compete against each other within the virtual space—i.e., Player vs. Player (PvP) activities.

In some implementations, when the online game is played via virtual reality 104*a* platform, a given user may input a broader range of commands compared to those available on non-virtual reality platform 104*b*. The input commands via the virtual reality platform 104*a* may include the user performing the action as an input command. The user may also be able to look around and/or move about the virtual space in which the online game is played.

The game component 112 may be configured to execute and/or perform user actions to facilitate participation of the users in the online game and/or with each other in response to receiving game commands input by the users. Execution and/or performance of the user action by the game component 112 may produce changes to the game state, which may reflect progresses and/or results of the user actions. In some examples, state changes caused by the execution of the user actions may be recorded in the electronic storage 110 to facilitate persistency throughout the instance of the online game. In some examples, execution of the user actions may not produce persistent changes to the game state (e.g., a user character jumping forward and backward successively may not produce any perceivable game state changes to other users).

Gameplay component 114 may be configured to monitor gameplay by the users via the virtual reality platforms 104*a*. Monitoring the gameplay of users may include tracking and/or storing game commands and/or information related to the game commands received from virtual reality platforms associated with the users. In some implementations, monitoring the gameplay may include monitoring an amount of gameplay via the virtual reality platform and/or the non-virtual reality platform associated with the user. For example, monitoring the gameplay by the first user may include monitoring an amount of gameplay by the first user via the first platform (e.g., a virtual reality platform).

The amount of gameplay may indicate an amount of time playing the game via a given platform. In some implementations, the amount of gameplay may indicate an amount of time playing the game via a virtual reality platform. For example, the amount of gameplay may indicate an amount of time the first user has played the online game via the first platform. The amount of time may include a total amount of time or an amount of time per some defined segment of time or actions. For example, the amount of time may include one or more of a cumulative amount of time, an amount of time for a given period of time (e.g., hour(s), day(s), week(s), month(s), etc.), an amount of time per play session, an amount of time per level within the online game, an average amount of time, a frequency, and/or any other amount of time. By way of non-limiting example, an amount of gameplay may indicate that the user has played the online game via the virtual reality platform for 15 minutes on a given day. By way of another non-limiting example, an amount of gameplay may indicate that the user has played the online game via the virtual reality platform twice a day on average over the past month (e.g., frequency).

In some implementations, the amount of gameplay may relate to a user's activity within the online game. For example, the amount of gameplay may describe an accomplishment or action within the online game that the user has performed and/or completed. The amount of gameplay may include one or more of a quantity of experience segments completed, a level achieved, a boss defeated, an amount of virtual items and/or resources used and/or obtained, an amount of stamina depleted and/or obtained, one or more actions performed, and/or other amounts of gameplay. Some online games may be segmented into experience segments. Experience segments may describe portions of the online game that may be completed and/or played by the users. Experience segments may, for example, include one or more of a game tile, game level, event, challenge, quest, nodes, mini-game, and/or other experience segment within the online game. By way of non-limiting example, the amount of gameplay may indicate that the user has completed one game tile via the virtual reality platform during their current game session. By way of another non-limiting example, the amount of gameplay may indicate that the user has participated in two mini-games via the virtual reality platform.

Gameplay component 114 may be configured to monitor the amount of gameplay by a given user via a given platform continuously and/or in a re-occurring manner. In some implementations, gameplay component 114 may be configured to monitory gameplay of the online game by the users via the non-virtual reality platforms. Gameplay via the non-virtual reality platforms may be monitored instead of or in addition to monitoring gameplay via the virtual reality platforms.

In some implementations, system 100 may include user component 116. User component 116 may be configured to manage one or more user accounts associated with individual users of the online game. The user accounts managed by user component 116 may include user information regarding the individual users of the online game. The user information may be stored in a network storage location such as the electronic storage 110, and/or any other storage locations. User component 116 may be configured to manage user accounts comprising user information regarding the users. The user information managed by user component 116 and/or included in the user accounts may include gameplay information for the users. The gameplay information may be determined by gameplay component 114 by monitoring gameplay by the users via the virtual reality platforms and/or the non-virtual reality platforms. The user information may include information reflecting a balance of stored consideration associated with the individual user usable in the given online game. The stored consideration may include, for example virtual currencies, real-world money, virtual objects, virtual resources, real-world objects (e.g., coupons) and/or any other stored consideration usable in the online game. Balances of such stored consideration may be maintained, modified, account, retrieved, tracked, and/or otherwise managed by the user component 116. By way of non-limiting example, the user information in the user account associated with the user for the online game may reflect that the user has 50 gems (e.g., a virtual currency) in the online game; and/or the user information in the user account associated with the user for the online game may reflect that the user has earned 30 ores (e.g., a virtual currency) in online game via a virtual reality platform or a non-virtual reality platform.

The user information in the user account associated with the given user for the online game may include historic transaction information indicating previous spending by the user in the online game via a given platform. In some exemplary implementations, such historic transaction information may reflect various statistics and details about the individual spending by the user via individual ones of the virtual reality platform(s) and/or the non-virtual reality platform(s). Examples of such statistics may include a number of times a user spends virtual currency in exchange for virtual items (e.g., a number of transactions), a frequency of such spending by the user with in a time period of interest (e.g., past 24 hours, past week, past month, etc.), a spend velocity (e.g., rate of spending), and/or any other statistics.

Platform component 118 may be configured to limit gameplay of the online via the virtual reality platforms. Gameplay via the virtual reality platforms may be limited responsive to the amount of gameplay determined by gameplay component 114, reaching a gameplay threshold. Limiting gameplay via the virtual reality platform may include restricting access to the online game via the virtual reality platform. Access to the online game through the virtual reality platform may be restricted for a given user based on the given user reaching a gameplay threshold. The access via the virtual reality platform associated with the user may be restricted until a requirement is satisfied. As such, for example, responsive to the amount of gameplay by the first user via the first platform (e.g., the virtual reality platform) reaching a gameplay threshold, access to the online game through the first platform may be restricted for the first user.

The gameplay threshold may be a limit on the amount of gameplay a user may participate in via a given platform (e.g., the virtual reality platform or the non-virtual reality platform) for a given period of time and/or segment of the online game. The gameplay threshold may indicate an amount of time playing the game via the given platform that a given user may play for a given period of time and/or segment of the online game prior to the virtual reality platform being restricted. In some implementations, the gameplay threshold may indicate an amount of activity a user may have within the online game via the given platform before the virtual reality platform is restricted. The gameplay threshold may be a value, outcome, achievement, action, quantity, and/or other threshold. The gameplay threshold may be reached responsive to the amount of gameplay reaching and/or breaching the threshold value, outcome, achievement, action, and/or quantity.

By way of non-limiting example, the gameplay threshold may indicate that a user is able to play up to 3 game tiles and/or quests per gaming session via the virtual reality platform. Once the user initiates gameplay on their third gameplay tile via the virtual reality platform, the gameplay threshold may be reached. By way of another non-limiting example, that gameplay threshold may indicate that a user is able to play the online game via the virtual reality platform for an hour a day. Once the user has played the online game for 60 minutes in any given day via the virtual reality platform, the gameplay threshold may be reached. The gameplay threshold may limit the virtual reality experiences of a user such that the user may be enticed to play the online game via other platforms.

In some implementations, platform component 118 may be configured to determine the gameplay threshold. The gameplay threshold may be determined based on one or more of input and/or selection by the online game provider; the gameplay of the online game via the virtual reality platform and/or the non-virtual reality platform monitored by gameplay component 114, an economic valuation determined for a given user, spending of a given user in the online game, and/or other information.

Platform component 118 may be configured to limit access to the online game through one or more of the virtual reality platforms and/or the non-virtual reality platforms. Limiting access to the online game via a given platform may include ceasing to provide the online game and/or present views of the online game to the user via the given platform, not performing operations in the game instance in response to commands received from the given platform, providing a notification of a requirement that must be satisfied to further access the game via the given platform, and/or otherwise limiting access to the online game via the given platform once the gameplay threshold has been reached and/or breached. In some implementations, access via a given platform may be limited in a manner such that the user can still interact with the online game and/or virtual space but their interactions will not be reflected in the instance of the online game and/or will not progress the user along any skill tree associated with the online game. Access to the online game via a given platform may or may not be limited immediately responsive to the gameplay threshold being reached. For example, access to the online game via the given platform may be limited after the user completes their present segment of the online game and/or reaches a breaking point.

Platform component 118 may limit gameplay of the online game via the virtual reality platform(s). Access to the online game through the virtual reality platform(s) and/or another platform may be restricted for one of more users until a requirement is satisfied. For example, access to the online game through the first platform may be restricted for the first user until a first requirement is satisfied. Platform component may communicate with requirement component 120 in order to determine whether the requirement has been satisfied. Responsive to a determination that the requirement has been satisfied by the user, access to the online game through the first platform may be enabled (e.g., re-enabled) for the first user.

Platform component 118 may enable the user to play the online game via the non-virtual reality platform when access to the online game via the virtual reality platform is limited and/or while the requirement is unsatisfied. For example, the users may be able to play the online game via the non-virtual reality platforms while the gameplay of the online game via the virtual reality platforms is restricted. As such, the first user may be able to play the online game via the second platform while the first requirement is unsatisfied. Limiting gameplay of the online game via the virtual reality platforms until a requirement is satisfied, but still allowing/enabling gameplay of the online game via the non-virtual reality platforms while the requirement is unsatisfied may encourage users to participate in the online game via the non-virtual reality platforms. As such, system 100 may encourage a balance between virtual reality gameplay and non-virtual reality gameplay by the users.

In some implementations, the first requirement may be a requirement that must be satisfied by the user via the non-virtual reality platform. For example, the first user may have to play the online game and/or perform one or more actions within the online game via the second platform (e.g., the non-virtual reality platform) in order to regain access to the online game via the first platform (e.g., the virtual reality platform).

By way of non-limiting example, the requirement may be to either wait for 30 minutes or pay 30 gems, wherein performance of either would satisfy the requirement. By way of another non-limiting example, the requirement may include a wait period of one hour wherein the user has an option to reduce the requirement to a wait period of 10 minutes by paying 20 gems. By way of another non-limiting example, the requirement may be to play a game time (e.g., an experience segment) of the online game via the non-virtual reality platform.

Responsive to the first user satisfying the first requirement, access to the online game through the first platform (e.g., virtual reality platform) may be enabled for the first user. As such, the first user may play the online game via the first platform until a given amount of gameplay reaches a given gameplay threshold. Responsive to the given amount of gameplay reaching the given threshold, access to the online game through the first platform may be restricted until the given requirement is satisfied. Enabling and restricting access to the online game via the virtual reality platform may be performed in a continuous and/or ongoing manner as set forth herein.

In some implementations, requirement component 120 may be configured to determine the requirement based on the amount of gameplay by the user via the virtual reality platform and/or the non-virtual reality platform. As such, requirement component 120 may be configured to determine the first requirement based on one or both of the amount of gameplay by the first user via the first platform, and the second amount of gameplay by the first user via the second platform. By way of non-limiting example, if the amount of gameplay via the virtual reality platform and the second amount of gameplay via the non-virtual reality platform indicates the user plays the online game for an hour a week, the requirement determined may be a 5 minute waiting period. In comparison, if the amount of gameplay via the virtual reality platform and the second amount of gameplay via the non-virtual reality platform indicates the user plays the online game for 6 hours a week, the requirement determined may be a 20 minute waiting period.

Requirement component 120 may be configured to determine whether the requirement (e.g., the first requirement) has been satisfied by the user (e.g., the first user). Requirement component 120 may determine whether the requirement has been satisfied by the user based on the user's gameplay monitored by gameplay component 114.

Notification component 122 may be configured to effectuate presentation of a notification to a user via a given platform. The notification presented may indicate that the gameplay threshold has been reached. In some implementations, the notification may indicate a requirement that must be satisfied in order to regain access to the online game via the virtual reality platform. For example, the notification may indicate the first requirement to the first user via the first platform (e.g., virtual reality platform). In some implementations, notification component 122 may be configured to determine and/or present one or more offers and/or options for satisfying a given requirement (e.g., such that a user may be able to re-access the game via the virtual reality platform). The notification may include the one or more offers and/or options for satisfying the given requirement. The offers may include user selection options to satisfy the given requirement. For example, if the requirement is to pay 100 gems, the offer may include a button enabling the user to select and pay 100 gems to satisfy the requirement. The options may include one or more requirements from which the user may choose in order to satisfy the requirement. By way of non-limiting example, the requirement may include a wait period of 30 minutes required before a user can access the online game via the virtual reality platform, or a payment of 50 gems. The notification may indicate the wait period of 30 minutes and/or the option and/or offer to pay 50 gems. The notification may be presented to the user via the virtual reality platform and/or the non-virtual reality platform.

Figure 2:
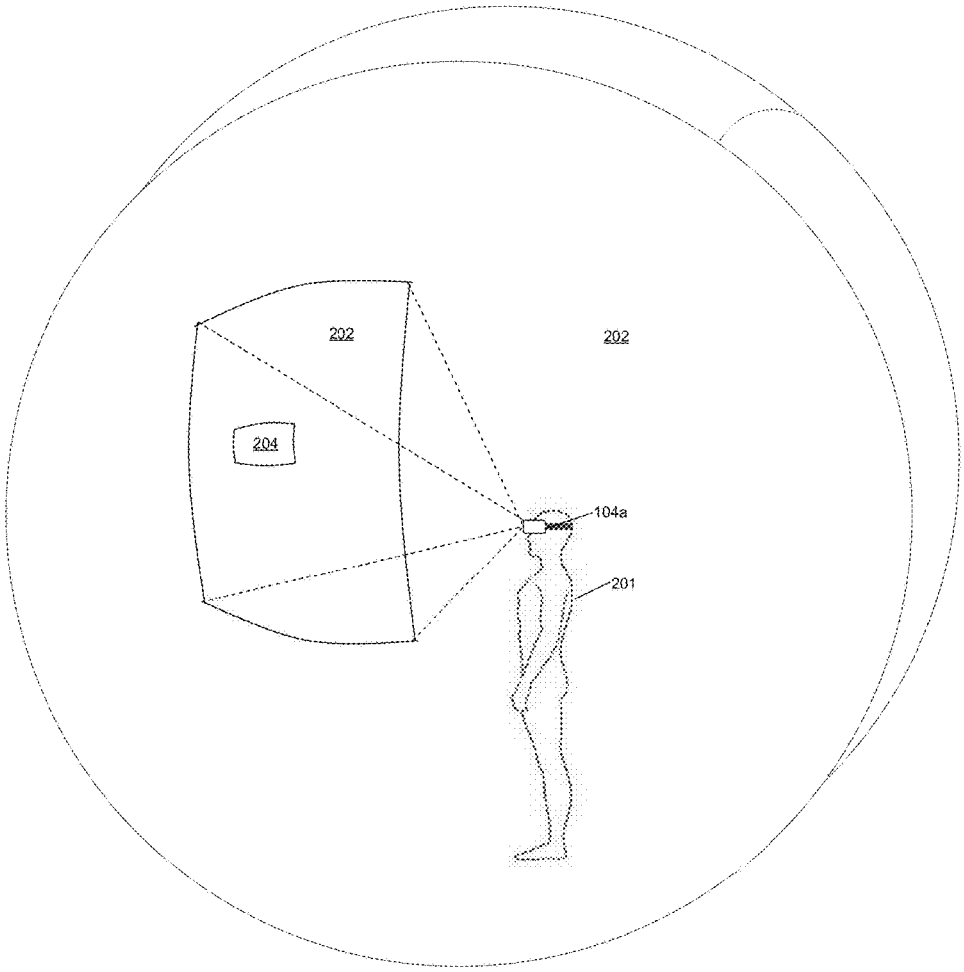
FIG. 2 illustrates a user playing the online game via a virtual reality platform, in accordance with one or more implementations

FIG. 2 depicts a user 201 playing the online game via a virtual reality platform 104*a*. Views 202 of the online game may be presented such that user 201 is immersed within the virtual space in which the online game is played. Responsive to user 201 reaching a given amount of gameplay via the virtual reality platform 200, access to the online game via virtual reality platform 104*a* may be restricted for user 201 until a requirement is satisfied. Notification 204 may indicate the requirement that user 201 must perform in order to regain access to the online game via the virtual reality platform 200. Notification 204 may be presented to user 201 via virtual reality platform 200. In some implementations, notification 204 may include one or more options and/or offers for satisfying the requirement.

Figure 3:
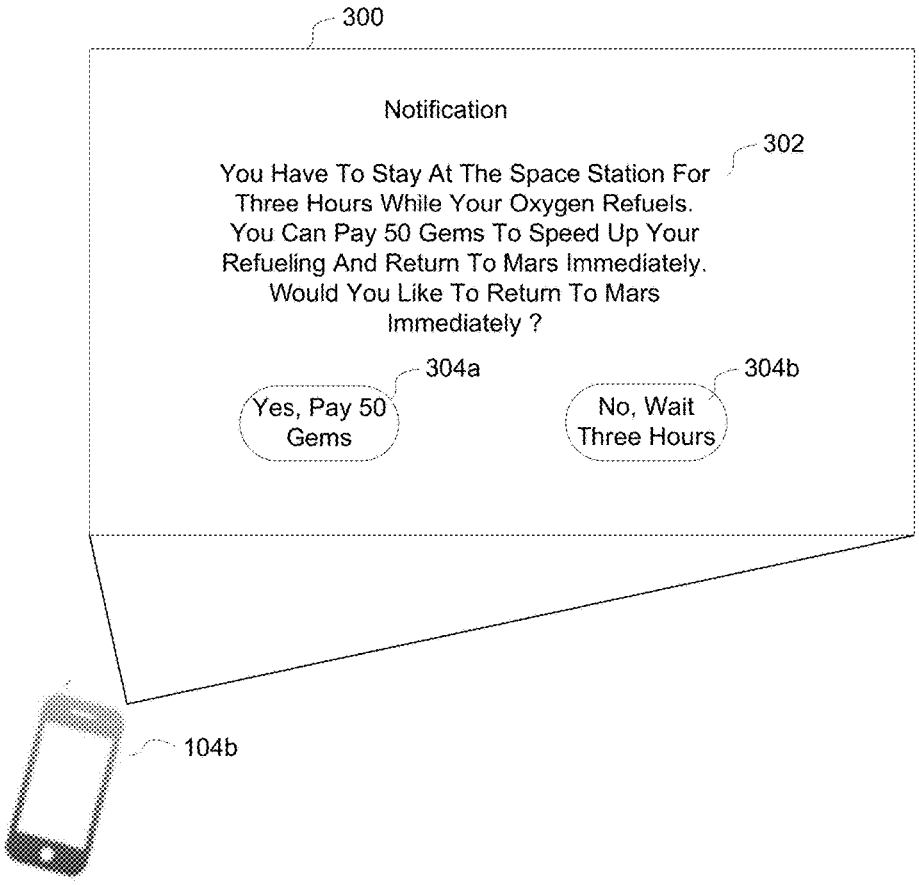
FIG. 3 illustrates an exemplary notification that includes an indication of the requirement that must be performed in order for the user to return to the virtual reality platform, in accordance with one or more implementations.

FIG. 3 depicts an exemplary notification 300 that includes an indication 302 of the requirement that must be performed in order for the user to return to the virtual reality platform (e.g., representing a user on Mars, and/or within any other virtual space). Notification 300 may include options 304. The user may perform either one of options 304 to satisfy the requirement. Option 304*a* may include an offer to "Pay 50 Gems." Responsive to the user selecting option 304*a*, 50 gems may be deducted from an inventory of virtual items (e.g., including virtual currency) associated with the user. Selecting option 304*a* and paying 50 gems may immediately satisfy the requirement such that access to the online game via the virtual reality platform may no longer be restricted. Selecting option 304*b* may return the user to the online game played via the non-virtual reality platform 104 (e.g., representing the user at the space station, and/or within any other virtual space). Selecting option 304*b*, waiting for three hours, and/or playing the online game via the non-virtual reality platform until 3 hours has passed, may satisfy the requirement.

Returning to FIG. 1, the client computing platform(s) 104 may include one or more processors, memory, display devices, head-mounted display devices, sensors, and/or any other components. The processor(s) may be configured to execute machine-readable instructions to launch and/or implement one or more client game applications associated with the online games. In some implementations, the machine-readable instructions may cause the processors of one of more client computing platforms to perform functionality the same as or similar to the functionality performed by one or more components of system 100.

The client computing platform(s) 104 may be configured to: present a graphical representation of the virtual space (e.g., a virtual reality representation and/or a non-virtual reality representation) corresponding to a given online game; provide controls and/or sense input commands enabling the given user to maneuver virtual items, initiate actions, and/or purchase virtual item(s) usable in the online game(s) within the virtual space associated with the online game; determine information for implementing game interfaces for the online game(s) hosted by system 100; obtain state information regarding a given online game hosted by the system 100; determine view information (e.g., a view point, field of view, eye/head movement, and/or location) of the user at a given time; determine a level of rendering of a scene in the online game based on the state information and view information; determining one or more action menus for presentation to the user in the game interface; facilitate interaction by the given user in the online game(s) and/or interaction with other users; communicate with sever(s) 102 (e.g., receive and/or transmitting information to/from servers 102); and/or provide any other functionality. In some implementations, client computing platform 104 may be a virtual reality platform and/or a non-virtual reality platform. Client computing platform 104 may be configured to communicate with, transmit information to, and/or receive information from one or more of servers 102, and/or other components of system 100.

The server(s) 102, client computing platform(s) 104, and/or external resources 106 may be operatively linked via one or more electronic communication links. For example, such electronic communication links may be established, at least in part, via a network such as the Internet and/or other networks. It will be appreciated that this is not intended to be limiting, and that the scope of this disclosure includes implementations in which servers 102, client computing platforms 104, and/or external resources 106 may be operatively linked via some other communication media.

A given client computing platform 104 may include one or more processors configured to execute computer program components. The computer program components may be configured to enable an expert or user associated with the given client computing platform 104 to interface with system 100 and/or external resources 106, and/or provide other functionality attributed herein to client computing platforms 104. By way of non-limiting example, the given client computing platform 104 may include one or more of a virtual reality system, a head-mounted virtual reality display, desktop computer, a laptop computer, a handheld computer, a tablet computing platform, a NetBook, a Smartphone, a gaming console, and/or other computing platforms.

The external resources 106 may include sources of information, hosts and/or providers of virtual environments outside of system 100, external entities participating with system 100, and/or other resources. In some implementations, some or all of the functionality attributed herein to external resources 106 may be provided by resources included in system 100.

The server(s) 102 may include electronic storage 110, one or more processors 108, and/or other components. The server(s) 102 may include communication lines, or ports to enable the exchange of information with a network and/or other computing platforms. Illustration of server(s) 102 in FIG. 1 is not intended to be limiting. The server(s) 102 may include a plurality of hardware, software, and/or firmware components operating together to provide the functionality attributed herein to server(s) 102. For example, server(s) 102 may be implemented by a cloud of computing platforms operating together as server(s) 102.

Electronic storage 110 may comprise electronic storage media that electronically stores information. The electronic storage media of electronic storage 110 may include one or both of system storage that is provided integrally (i.e., substantially non-removable) with server(s) 102 and/or removable storage that is removably connectable to server(s) 102 via, for example, a port (e.g., a USB port, a FireWire port, etc.) or a drive (e.g., a disk drive, etc.). Electronic storage 110 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The Electronic storage 110 may include one or more virtual storage resources (e.g., cloud storage, a virtual private network, and/or other virtual storage resources). Electronic storage 110 may store software algorithms, information determined by processor 108, information received from server(s) 102, information received from client computing platforms 104, and/or other information that enables server(s) 102 to function as described herein.

Processor(s) 108 is configured to provide information processing capabilities in server(s) 102. As such, processor 108 may include one or more of a digital processor, an analog processor, a digital circuit designed to process information, an analog circuit designed to process information, a state machine, and/or other mechanisms for electronically processing information. Although processor 108 is shown in FIG. 1 as a single entity, this is for illustrative purposes only. In some implementations, processor 108 may include a plurality of processing units. These processing units may be physically located within the same device, or processor 108 may represent processing functionality of a plurality of devices operating in coordination. The processor 108 may be configured to execute components 112, 114, 116, 118, 120, 122. Processor 108 may be configured to execute components 112, 114, 116, 118, 120, 122 by software; hardware; firmware; some combination of software, hardware, and/or firmware; and/or other mechanisms for configuring processing capabilities on processor 108.

It should be appreciated that although components 112, 114, 116, 118, 120, 122 are illustrated herein as being co-located within a single processing unit, in some other implementations, one or more of components 112, 114, 116, 118, 120, 122 may be located remotely from the other components. The description of the functionality provided by the different components 112, 114, 116, 118, 120, 122 described below is for illustrative purposes, and is not intended to be limiting, as any of components 112, 114, 116, 118, 120, 122 may provide more or less functionality than is described. For example, one or more of components 112, 114, 116, 118, 120, 122 may be eliminated, and some or all of its functionality may be provided by other ones of components 112, 114, 116, 118, 120, 122. As another example, processor 108 may be configured to execute one or more additional components that may perform some or all of the functionality attributed below to one of components 112, 114, 116, 118, 120, 122.

Figure 4:
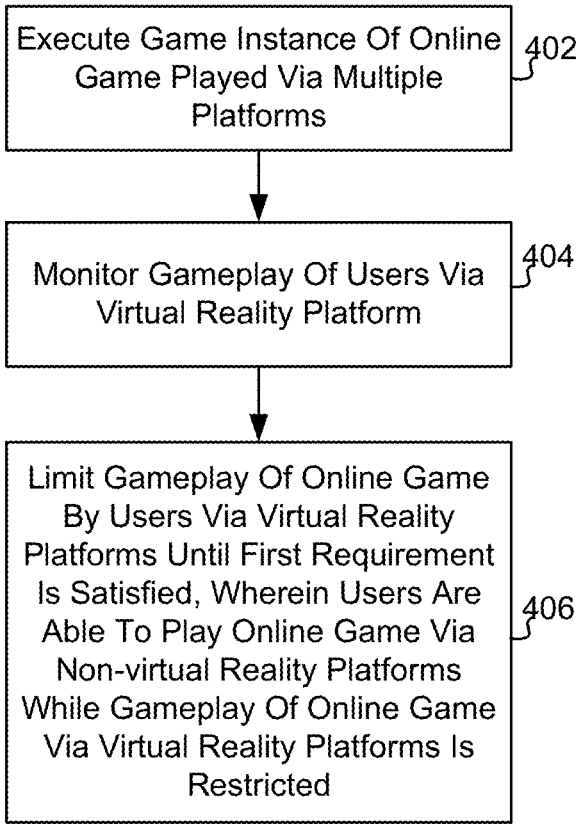
FIG. 4 illustrates a method for making game content from a single online game accessible to users via multiple platforms.

FIG. 4 illustrates a method for making game content from a single online game accessible to users via multiple platforms, in accordance with one or more implementations. The operations of method 400 presented below are intended to be illustrative. In some embodiments, method 400 may be accomplished with one or more additional operations not described, and/or without one or more of the operations discussed. Additionally, the order in which the operations of method 400 illustrated in FIG. 4 and described below is not intended to be limiting.

In some embodiments, method 400 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 400 in response to instructions stored electronically on an electronic storage medium. The one or more processing devices may include one or more devices configured through hardware, firmware, and/or software to be specifically designed for execution of one or more of the operations of method 400.

At an operation 402, a game instance of the online game played via multiple platforms may be executed. The game instance may be used to generate game state information that is transmitted to client computing platforms over a network. The game state information may facilitate presentation of views of the online game to the users via the client computing platforms. Execution of the game instance further enables interaction by the users with the online game and/or each other by performing operations in the game instance in response to commands received over the network from the client computing platforms. The client computing platforms may include virtual reality platforms and non-virtual reality platforms. The virtual reality platforms may include a first platform associated with a first user. The non-virtual reality platforms may include a second platform associated with the first user. In some implementations, operation 402 may be performed by a game component the same as or similar to game component 112 (shown in FIG. 1 and described herein).

At an operation 404, gameplay of the online game by the users via the virtual reality platforms may be monitored. Monitoring the gameplay by the first user may include monitoring an amount of gameplay by the first user via the first platform. In some implementations, operation 404 may be performed by a gameplay component the same as or similar to gameplay component 114 (shown in FIG. 1 and described herein).

At operation 406, gameplay of the online game via the virtual reality platforms may be limited. Responsive to the amount of gameplay by the first user reaching a gameplay threshold, access to the online game through the first platform may be restricted for the first user. Access may be restricted for the first user until a first requirement is satisfied. The users may be able to play the online game via the non-virtual reality platforms while the gameplay of the online game via the virtual reality platforms is restricted. As such, the first user may be able to play the online game via the second platform while the first requirement is unsatisfied. In some implementations, operation 406 may be performed by a platform component and/or a requirement component the same as or similar to platform component 118 and/or requirement component 120 (shown in FIG. 1 and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A multi-platform gaming system comprising:

one or more data stores configured to store:

computer-executable instructions;

user account information including user preferences and game state information associated with one or more user accounts; and content rendering instructions for rendering content for a single online game on a plurality of platforms, which include a first platform and a second platform, wherein the first platform is configured to simulate immersion within online games and is different from the second platform;

a network interface configured to communicate with a plurality of network service devices; and one or more physical computer processors in communication with the one or more data stores, wherein the computer-executable instructions, when executed, configure the one or more processors to:

receive, via the network interface, an electronic request associated with a first client computing device to access and play a first online game, the electronic request comprising:

an electronic indication of a user account associated with a first user; and platform identifying information;

obtain, via the one or more data stores, based on the electronic request, first user account information associated with the first user including first game state information associated with the first online game;

determine whether the electronic request is associated with the first platform or the second platform based at least in part on the platform identifying information;

if the electronic request is from the first platform:

obtain content rendering instructions pertaining to the first platform from the one or more data stores;

generate first platform content based at least in part on the obtained content rendering instructions and the obtained first game state information, wherein the first platform content includes first platform specific settings associated with the first platform including a set of motion inputs, views, and visibility, and the first platform content is further configured to be displayed stereoscopically;

transmit the first platform content to the first client computing device for display and interaction;

track movements of the first client computing device in a physical space;

automatically match the tracked movements to a virtual space in which the first online game is played such that the tracked movements in the physical space correspond to movements of a character or viewpoint within the virtual space;

transmit the first platform content to the first client computing device for display and interaction;

if the electronic request is from the second platform:

obtain the content rendering instructions pertaining to the second platform from the one or more data stores;

generate second platform content based at least in part on the obtained content rendering instructions and the obtained first game state information, wherein the second platform content includes second platform specific settings associated with the second platform including a set of motion inputs, views, and visibility and is different than the first platform specific settings, and the second platform content is adjusted to depict operations in the associated game instance in response to commands received over the network interface from the first client computing device;

transmit the second platform content to the first client computing device for display and interaction.

2. The system of claim 1, wherein the first platform supports additional or an increased set of motion inputs, views, and visibility than the second platform.

3. The system of claim 1, wherein the movements of the first client computing device are tracked via head or eye tracking of the first user.

4. The system of claim 1, wherein the first platform content and second platform content are different based on one or more of: dimension differences, location differences within the virtual space, or character differences.

5. The system of claim 1, wherein one or more data stores further comprises game instance information which is configured to be used to generate game state information.

6. The system of claim 5, wherein game instance information is persistent and can continue on whether or not individual users are currently logged in or participating in the online games.

7. The system of claim 1, wherein the virtual space comprises topography information.

8. The system of claim 1, wherein the one or more physical processors are further configured by machine readable instructions to:

if the first platform content is being transmitted to the first client computing device for display and interaction, restrict access to the first platform content by other client computing devices;

if the second platform content is being transmitted to the second client computing device for display and interaction, restrict access to the second platform content by other client computing devices.

9. The system of claim 1, wherein the one or more physical processors are further configured by machine readable instruction to:

based on the tracked movements, effectuate presentation of a notification to the first user via the first client computing device.

10. A computer-implemented method of providing gaming content in an online game to multiple platforms, the computer-implemented method comprising:

receiving, via a network interface, an electronic request associated with a first client computing device to access and play a first online game, the electronic request comprising:

an electronic indication of a user account associated with a first user; and platform identifying information;

obtaining, via one or more data stores, based on the electronic request, first user account information associated with the first user including first game state information associated with the first online game;

determining whether the electronic request is associated with the first platform or the second platform based at least in part on the platform identifying information;

if the electronic request is from the first platform:

obtaining content rendering instructions pertaining to the first platform from the one or more data stores;

generating first platform content based at least in part on the obtained content rendering instructions and the obtained first game state information, wherein the first platform content includes first platform specific settings associated with the first platform including a set of motion inputs, views, and visibility, and the first platform content is further configured to be displayed stereoscopically;

transmitting the first platform content to the first client computing device for display and interaction;

tracking movements of the first client computing device in a physical space;

automatically matching the tracked movements to a virtual space in which the first online game is played such that the tracked movements in the physical space correspond to movements of a character or viewpoint within the virtual space;

transmitting the first platform content to the first client computing device for display and interaction;

if the electronic request is from the second platform:

obtaining the content rendering instructions pertaining to the second platform from the one or more data stores;

generating second platform content based at least in part on the obtained content rendering instructions and the obtained first game state information, wherein the second platform content includes second platform specific settings associated with the second platform including a set of motion inputs, views, and visibility and is different than the first platform specific settings, and the second platform content is adjusted to depict operations in the associated game instance in response to commands received over the network interface from the first client computing device;

transmitting the second platform content to the first client computing device for display and interaction.

11. The computer-implemented method of claim 10, wherein the first platform supports additional or an increased set of motion inputs, views, and visibility than the second platform.

12. The computer-implemented method of claim 10, wherein the movements of the first client computing device are tracked via head or eye tracking of the first user.

13. The computer-implemented method of claim 10, wherein the first platform content and second platform content are different based on one or more of: dimension differences, location differences within the virtual space, or character differences.

14. The computer-implemented method of claim 10, wherein one or more data stores further comprises game instance information which is configured to be used to generate game state information.

15. The computer-implemented method of claim 10, wherein the one or more physical processors are further configured by machine readable instructions to:

if the first platform content is being transmitted to the first client computing device for display and interaction, restricting access to the first platform content by other client computing devices;

if the second platform content is being transmitted to the second client computing device for display and interaction, restricting access to the second platform content by other client computing devices.

16. The computer-implemented method of claim 10, wherein the one or more physical processors are further configured by machine readable instruction to:

based on the tracked movements, effectuating presentation of a notification to the first user via the first client computing device.

17. A non-transitory computer-readable storage medium storing computer executable instructions that, when executed by one or more computing devices, configure the one or more computing devices to perform operations comprising:

receiving, via a network interface, an electronic request associated with a first client computing device to access and play a first online game, the electronic request comprising:

an electronic indication of a user account associated with a first user; and platform identifying information;

obtaining, via one or more data stores, based on the electronic request, first user account information associated with the first user including first game state information associated with the first online game;

determining whether the electronic request is associated with the first platform or the second platform based at least in part on the platform identifying information;

if the electronic request is from the first platform:

obtaining content rendering instructions pertaining to the first platform from the one or more data stores;

generating first platform content based at least in part on the obtained content rendering instructions and the obtained first game state information, wherein the first platform content includes first platform specific settings associated with the first platform including a set of motion inputs, views, and visibility, and the first platform content is further configured to be displayed stereoscopically;

transmitting the first platform content to the first client computing device for display and interaction;

tracking movements of the first client computing device in a physical space;

automatically matching the tracked movements to a virtual space in which the first online game is played such that the tracked movements in the physical space correspond to movements of a character or viewpoint within the virtual space;

transmitting the first platform content to the first client computing device for display and interaction;

if the electronic request is from the second platform:

obtaining the content rendering instructions pertaining to the second platform from the one or more data stores;

generating second platform content based at least in part on the obtained content rendering instructions and the obtained first game state information, wherein the second platform content includes second platform specific settings associated with the second platform including a set of motion inputs, views, and visibility and is different than the first platform specific settings, and the second platform content is adjusted to depict operations in the associated game instance in response to commands received over the network interface from the first client computing device;

transmitting the second platform content to the first client computing device for display and interaction.

18. The non-transitory computer-readable storage medium of claim 17, wherein the first platform supports additional or an increased set of motion inputs, views, and visibility than the second platform.

19. The non-transitory computer-readable storage medium of claim 17, wherein the one or more physical processors are further configured by machine readable instructions to:

if the first platform content is being transmitted to the first client computing device for display and interaction, restricting access to the first platform content by other client computing devices;

if the second platform content is being transmitted to the second client computing device for display and interaction, restricting access to the second platform content by other client computing devices.

20. The non-transitory computer-readable storage medium of claim 17, wherein the one or more physical processors are further configured by machine readable instruction to:

based on the tracked movements, effectuating presentation of a notification to the first user via the first client computing device.

* * * * *